United States Patent [19]

Ueda et al.

[11] 4,241,433

[45] Dec. 23, 1980

[54] ELECTRONIC WATCH

[75] Inventors: Makoto Ueda; Masaharu Shida; Masataka Ikenishi; Joichi Miyazaki; Shozo Kushida; Hiromasa Nakanishi, all of Tokyo, Japan

[73] Assignee: Kabushiki Kaisha Daini Seikosha, Tokyo, Japan

[21] Appl. No.: 927,362

[22] Filed: Jul. 24, 1978

[30] Foreign Application Priority Data

Aug. 4, 1977 [JP] Japan ..... 52-93669

[51] Int. Cl.[3] ..... G04B 19/00; G04C 19/00; G04C 3/00

[52] U.S. Cl. ..... 368/76; 368/85; 368/217; 318/696

[58] Field of Search ..... 58/23 BA, 23 D, 34, 58/85.5; 318/317, 685, 696

[56] References Cited

U.S. PATENT DOCUMENTS

| | | | |
|---|---|---|---|
| 3,812,670 | 5/1974 | Nikaido et al. | 58/23 R |
| 4,129,981 | 12/1978 | Nomura et al. | 58/23 D |
| 4,150,536 | 4/1979 | Nakajima et al. | 58/23 D |
| 7,032,827 | 6/1977 | Dobratz et al. | 58/23 D X |

*Primary Examiner*—Vit W. Miska

*Attorney, Agent, or Firm*—Robert E. Burns; Emmanuel J. Lobato; Bruce L. Adams

[57] ABSTRACT

In an electronic watch a non-operation detecting circuit detects the non-operative condition of the stepping motor of the watch and produces a non-operation signal each time the stepping motor fails to operate in response to the standard pulse which drives the same. A counter counts the number of non-operation signals and stores the count for later use. A rotation detecting circuit detects the resumption of operation of the stepping motor in response to the standard pulse from the non-operative condition and a quick feed control circuit quickly advances the stepping motor in response to an input from the rotation detection circuit by thereafter supplying, instead of the standard pulses, the quick feed pulses to the drive circuit for the motor equal in number to the number of the non-operation signals counted in the counter. In this way the corrected time will be displayed by the watch even after being rendered inoperative as a result of an external condition such as low temperature or a high strength DC magnetic field.

6 Claims, 11 Drawing Figures

ELECTRONIC WATCH

BACKGROUND OF THE INVENTION

The present invention relates to an electronic watch capable of displaying the time by the use of hands which are operated by a stepping motor.

Among the known electronic watches, which can display in analog form the time by means of hands, there is one which uses the stepping motor as a drive means for the hands. In this electronic watch, the hands sometimes stop due to the occurrence of a non-operative condition of the stepping motor due to a strong external D.C. magnetic field or a very low ambient temperature.

SUMMARY OF THE INVENTION

The purpose of the present invention is therefore to provide an electronic watch wherein, when the stepping motor temporarily becomes in an operative condition because of some reason, the number of the unoperative conditions of the motor is stored in a memory and after the recovery of the operation of the motor, the indication of the hands is automatically adjusted to the exact time position by a quick feed operation by the amount of loss time.

DETAILED DESCRIPTION OF THE INVENTION

A detailed explanation of the embodiment according to the present invention will now be made in conjunction with the attached drawings.

Figure 1:
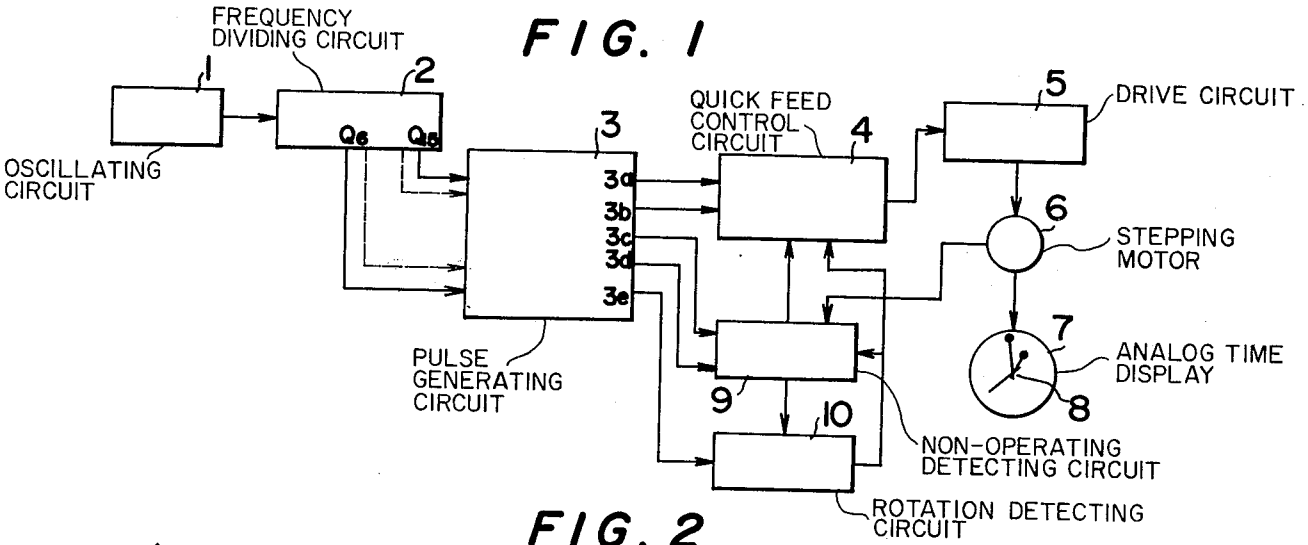
FIG. 1 shows a block diagram of the embodiment of the electronic watch according to the present invention.

Referring to FIG. 1, a block diagram of the electronic watch according to the present invention is shown. The reference numeral 1 shows an oscillating circuit capable of oscillating an original signal of, for instance, 32,768 Hz. The output of the oscillating circuit 1 is applied to a frequency dividing circuit 2 which consists of fifteen cascaded frequency dividing stages, each dividing into $\frac{1}{2}$ frequency. The outputs $Q_6$ through $Q_{15}$ from the frequency dividing stages 6 to 15 are fed to a pulse generating circuit 3. The pulse generating circuit 3 has five output terminals 3*a*–3*e*, the output terminal 3*a* of which producing a standard pulse $\phi a$ indicated by the logic equation.

$$\phi a = Q_9 \cdot Q_{10} \cdot Q_{11} \cdot Q_{12} \cdot Q_{13} \cdot Q_{14} \cdot Q_{15}$$

The output terminal 3*b* produces the inverting pulse $\phi b$ which is indicated by the logic equation $$\phi b = Q_9 \cdot Q_{10} \cdot Q_{11}$$

Similarly, the output terminal 3*c* produces a first detection pulse $\phi c$ which is indicated by the logic equation $$\phi c = Q_6 \cdot Q_7 \cdot Q_8 \cdot Q_9 \cdot Q_{10} \cdot Q_{11} \cdot \overline{Q}_{12} \cdot \overline{Q}_{13} \cdot \overline{Q}_{14} \cdot \overline{Q}_{15}$$

the terminal 3*d* produces the second detection pulse $\phi d$ which is indicated by the logic equation $$\phi d = Q_6 \cdot Q_7 \cdot Q_8 \cdot Q_{10} \cdot \overline{Q}_{11}$$

and, the terminal 3*e* produces the third detection pulse $\phi e$ which is indicated by the logic equation $$\phi e = Q_6 \cdot Q_7 \cdot \overline{Q}_8 \cdot \overline{Q}_9 \cdot \overline{Q}_{10} \cdot Q_{11}$$

Figure 2:
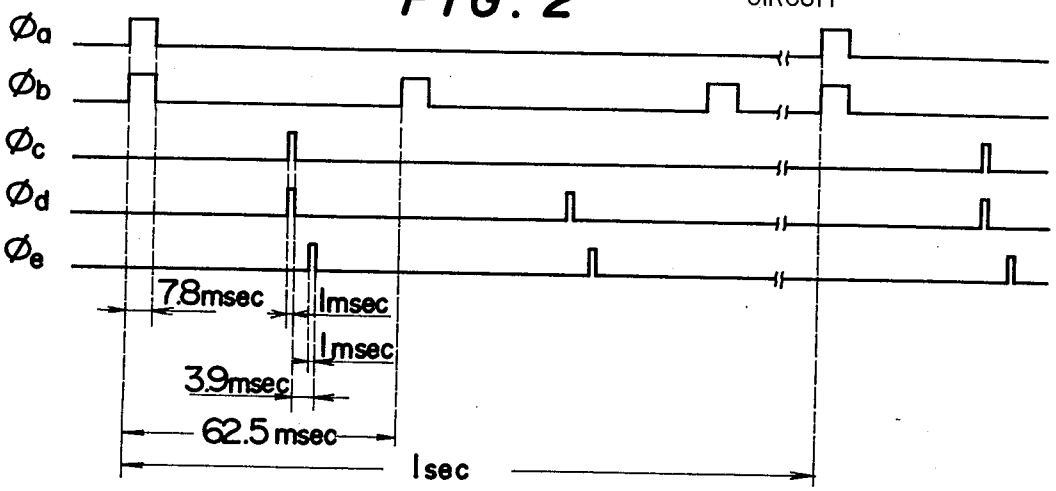
FIG. 2 shows a timing chart of the pulse produced from the pulse generating circuit in the circuit in FIG. 1.

The standard pulse $\phi a$ is the pulse having a frequency of 1 Hz which becomes the reference for the time measurement with the period being 1 sec and the pulse width being 7.8 msec. The first detection pulse $\phi c$ has the frequency of 1 Hz with the period being 1 sec and the pulse width being 1 msec. The second detection pulse $\phi d$ has the frequency of 16 Hz with the period of 62.5 msec and the pulse with of 1 msec. The third detection pulse $\phi e$ has the frequency of 16 Hz with the period of 62.5 msec and the pulse width of 1 msec. The first detection pulse $\phi c$ is advanced 38 msec in phase of the rise time with respect to the standard pulse $\phi a$, while the second detection pulse $\phi d$ is advanced the likewise 38 msec in phase of the rise time with respect to the quick feed pulse $\phi b$. Also, the third detection pulse $\phi e$ is advanced 3.9 msec in phase, with respect to the detection pulse $\phi d$. FIG. 2 shows a timing chart of each pulse which is output from the pulse generating circuit 3.

The standard pulse $\phi a$ and the quick feed pulse $\phi b$ produced from the pulse generating circuit 3 are selectively applied to the drive circuit 5 through the quick feed control circuit 4. A driving pulse is obtainable which changes its polarity alternatively in accordance with the standard pulse $\phi a$ or the quick feed pulse $\phi b$ to be input to the drive circuits. The driving pulse is applied to the coil of the stepping motor 6, thereby intermittently rotating the rotor of the stepping motor 6 in the predetermined direction. As a result of this, a display mechanism 7 having hands 8 capable of displaying the time in the analog form by operation of the stepping motor 6, can be driven.

Numeral 9 shows an non-operation detecting circuit which detects the non-operative condition of the stepping motor 6 when the watch is placed in a strong D.C. magnetic field or in a certain environment such as a very low temperature. The non-operation detecting circuit 9 produce the non-operation signal whenever the stepping motor 6 fails to operate even if the drive circuit 5 is provided with the driving pulse. The non-operation signal is produced either by the timing of the first detection pulse $\phi c$ or by the timing of the second detection pulse $\phi d$ produced from the pulse generating circuit 3, respectively, and is counted in the quick feed control circuit. The quick feed control circuit 4 memorizes the number of times of the non-operative condition of the stepping motor 6 by counting the non-operation signal. The circuit 4 supplies the quick feed pulse $\phi b$, in the place of the standard pulse $\phi a$, to the drive circuit 5 in response to the detection of the recovery of the stepping motor 6 in the rotation detecting circuit 10, thus driving the stepping motor 6 quickly and moving the hands 8 to the normal time display in one operation. As a result, the indication of the hands 8 which is retarded by the stopping of the stepping motor 6, is corrected.

The operation of the circuit according to the present invention shown in FIG. 1 will now be explained with reference to the drawings following FIG. 3. In this case, however, the circuit such as the oscillating circuit 1, the frequency dividing circuit 2, the pulse generating circuit 3 can be easily obtainable by utilizing conventional logic circuitry so that a detailed description thereof will be omitted.

Figure 3:
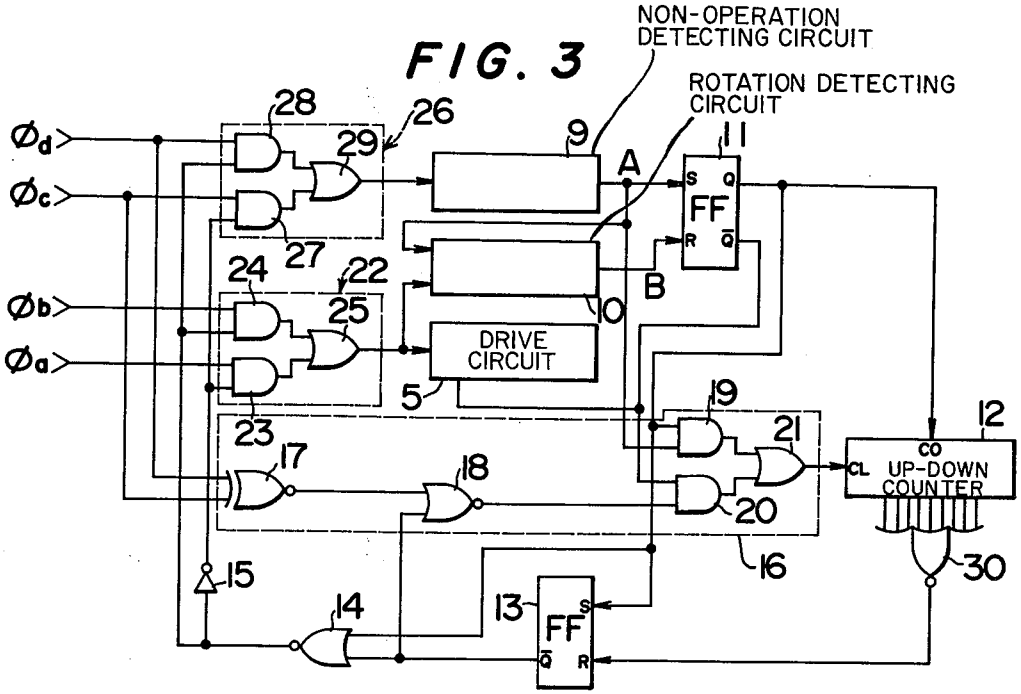
FIG. 3 shows a circuit diagram of the embodiment of the quick feed control circuit in FIG. 1.

FIG. 3 shows a construction of the quick feed control circuit 4 in which numeral 11 indicates a first flip-flop circuit (referred to as the "first FF" hereinafter), the set terminal S of which being applied with the non-operation signal A produced from the non-operation detecting circuit 9. The output Q thereof is applied to a control terminal CO of an up/down "counter" (referred to as counter hereinafter) 12 as well as to the set terminal S of the second flip-flop (referred to as the "second FF" hereinafter) 13. Moreover, the output Q of the first "FF" is applied to the input terminal of one side of a NOR gate 14 and the input terminal of a AND gate 19 in the first gate circuit 16. The output $\overline{Q}$ of the first FF11 is applied to one input terminal of the AND gate 20 in the first gate circuit 16 as well as to an input terminal of a AND gate 33 in the drive circuit 5 as will be described later. Moreover, the rotation signal B which is produced from the rotation detecting circuit 10 is applied to the reset terminal R of the first FF11.

The first gate circuit 16 includes an Exclusive NOR gate 17 to which the first detection pulse $\phi c$ and the second detection pulse $\phi d$ are applied, a NOR gate 18 to which the output from the gate 17 and the output $\overline{Q}$ of the second FF13 are applied, an AND gate 19 to which the non-operative signal A and the output $\overline{Q}$ are applied, an AND gate 20 to which the $\overline{Q}$ output of first FF11 and the output of the NOR gate 18 are applied, and an OR gate 21 to which the outputs of the two AND gates 19 and 20 are applied. The output of the first gate circuit 16, which is produced from the OR gate 21, is applied to the clock terminal CL of the counter 12. A second gate circuit 22 comprises an AND gate 23 to which the output of an inverter 15 capable of inverting the output of the NOR gate 14 and the standard pulse $\phi a$ are applied, an AND gate 24 to which the output of the NOR gate 14 and the quick feed pulse $\phi b$ are applied, and an OR gate 25 to which the outputs of the gates 23 and 24 are applied. A third gate circuit 26 comprises an AND gate 27 to which the output of the inverter 15 and the first detection pulse $\phi c$ are applied, an AND gate 28 to which the output of the NOR gate 14 and the second detection pulse $\phi d$ are applied, and an OR gate 29 to which the outputs of the two gates 27 and 28 are applied. The output of the third gate circuit 26 is obtained from OR gate 29, and the first detection pulse $\phi c$ and the second detection pulse $\phi d$ are selectively applied to the non-operation detecting circuit 9. The counter 12 operates in the up-mode when the signal to be applied to the control terminal CO is at a high potential, i.e., the logical "1", while it operates in the down-mode when the signal is low, i.e., the logical "0". The output of the counter 12 is applied to a NOR gate 30, while the output of the NOR gate 30 is applied to the reset terminal R of the second FF13.

Figure 4:
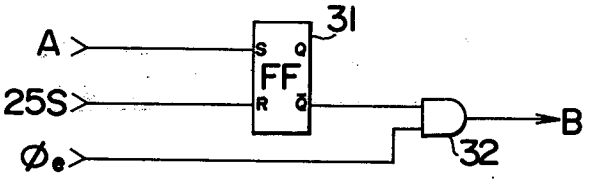
FIG. 4 shows a circuit of the embodiment of the rotation detecting circuit in FIG. 1.

FIG. 4 shows a circuit construction of the rotation detection circuit 10 which comprises a third flip-flop (referred to as the "third FF" hereinafter) 31 in which the non-operation signal A produced from the non-operation detecting circuit 9 and the output 25S from the OR gate 25 in the second gate circuit 22 are applied to the set terminal S and to the reset terminal R, respectively, and an AND gate 32 in which the output $\overline{Q}$ of the third "FF31" is applied to one input terminal thereof and the third detection pulse $\phi e$ is applied to the other input terminal thereof. The output of the rotation detecting circuit 10 is obtained from the AND gate 32 and it is applied to the reset terminal R of the first FF11 in the quick feed control circuit 4.

Figure 5:
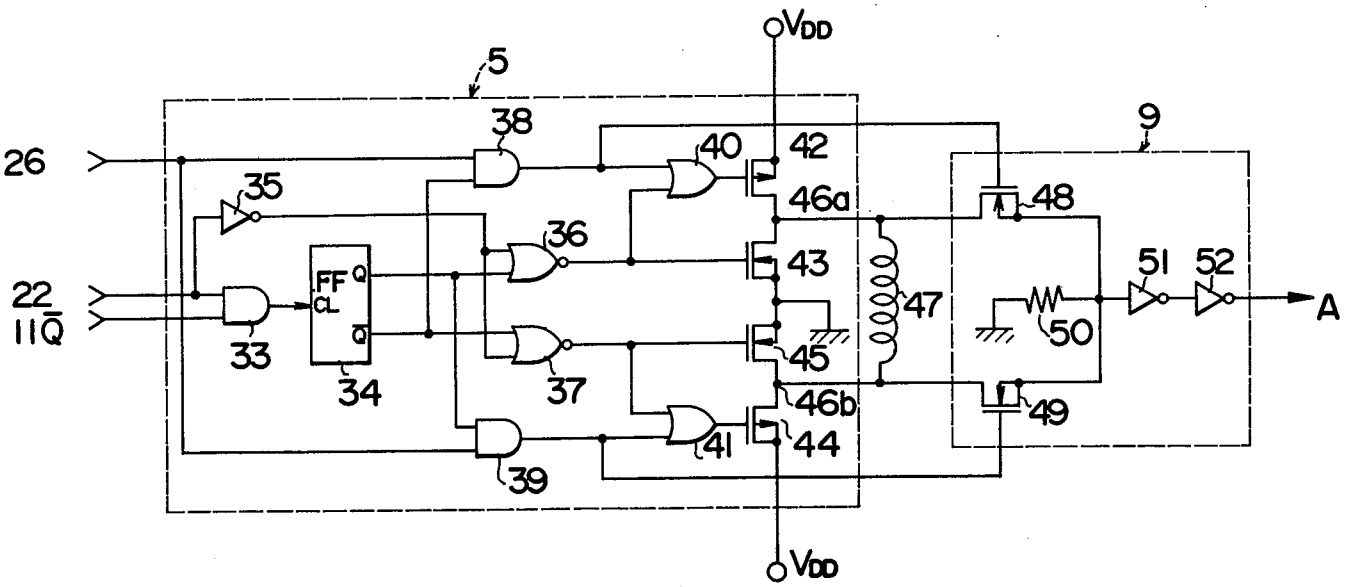
FIG. 5 shows a circuit of the embodiment of the drive circuit and the non operation detecting circuit in FIG. 1.

FIG. 5 shows the circuit construction of the drive circuit 5 and the non-operation detecting circuit 9. The drive circuit 5 comprises an AND gate 33 to which the signal 11$\overline{Q}$ from the output $\overline{Q}$ of the first FF11 in the quick feed control circuit 4 and either standard pulse $\phi a$ or quick feed pulse $\phi b$ passing through the third gate circuit 26 in the quick feed control circuit 4 are applied, a flip-flop (referred to as "FF" hereinafter) 34 as an inverting control circuit, to the clock terminal CL of which the output from the AND gate 33 is applied, an inverter 35 in which the standard pulse $\phi a$ or the quick feed pulse $\phi b$ are inverted, a NOR gate 36 to which the Q output from the FF34 and the output of the inverter 35 are applied, a NOR gate 35 to which the output $\overline{Q}$ from the FF34 and the output from the inverter 37 are applied, an AND gate 38 to which the $\overline{Q}$ output of FF34 and the first detection pulse $\phi c$ or the second detection pulse $\phi d$ are applied, an AND gate 39 to which the output Q of the FF34 and either the first detection pulse $\phi c$ or the second detection pulse $\phi d$ are applied, an OR gate 40 to which the outputs from the NOR gate 36 and the AND gate 38 are applied, an OR gate 41 to which the outputs from the NOR gate 37 and the AND gate 39 are applied, a P-MOS transistor 42 to the gate electrode of which the output from the OR gate 40 is applied, a N-MOS transistor 43 to the gate electrode of which the output from the NOR gate 36 is applied, a P-MOS transistor 44 to the gate electrode of which the output from the OR gate 41 is applied, and a N-MOS transistor 45 to the gate electrode of which the output from the NOR gate 37 is applied. The source electrodes of the P-MOS transistors 42 and 44 are connected to the high potential power supply terminal $V_{DD}$, while the source electrodes of the N-MOS transistors 43 and 45 are connected to ground. The output of the drive circuit 5 is picked up both at the common junction point 46*a* of the drains of the P-MOS transistors 42 and 43 and at the junction point 46*b* of N-MOS transistors 44 and 45. The coil 47 of the stepping motor 6 is connected between the point 46*a* and the point 46*b*.

The non-operation detecting circuit 9 comprises a N-MOS transistor 48 as a switching element to the gate electrode of which the first detection pulse $\phi c$ or the second detection pulse $\phi d$ is applied through the AND gate 38, a P-MOS transistor 49 as a switching element to the gate electrode of which the first detection pulse $\phi c$ or the second detection pulse $\phi d$ is applied through AND gate 39, a resistor 50 as a detecting element, one end of which is connected to the source electrodes of the N-MOS transistors 48 and 49, and the other end of which is connected to ground, an inverter 51 consisting of C-MOS as a binary logic circuit to which the terminal voltage of the resistor 50 is applied, and an inverter 52 which reverses the output thereof. The non-operation signal A is produced from the inverter 52.

Figure 6:
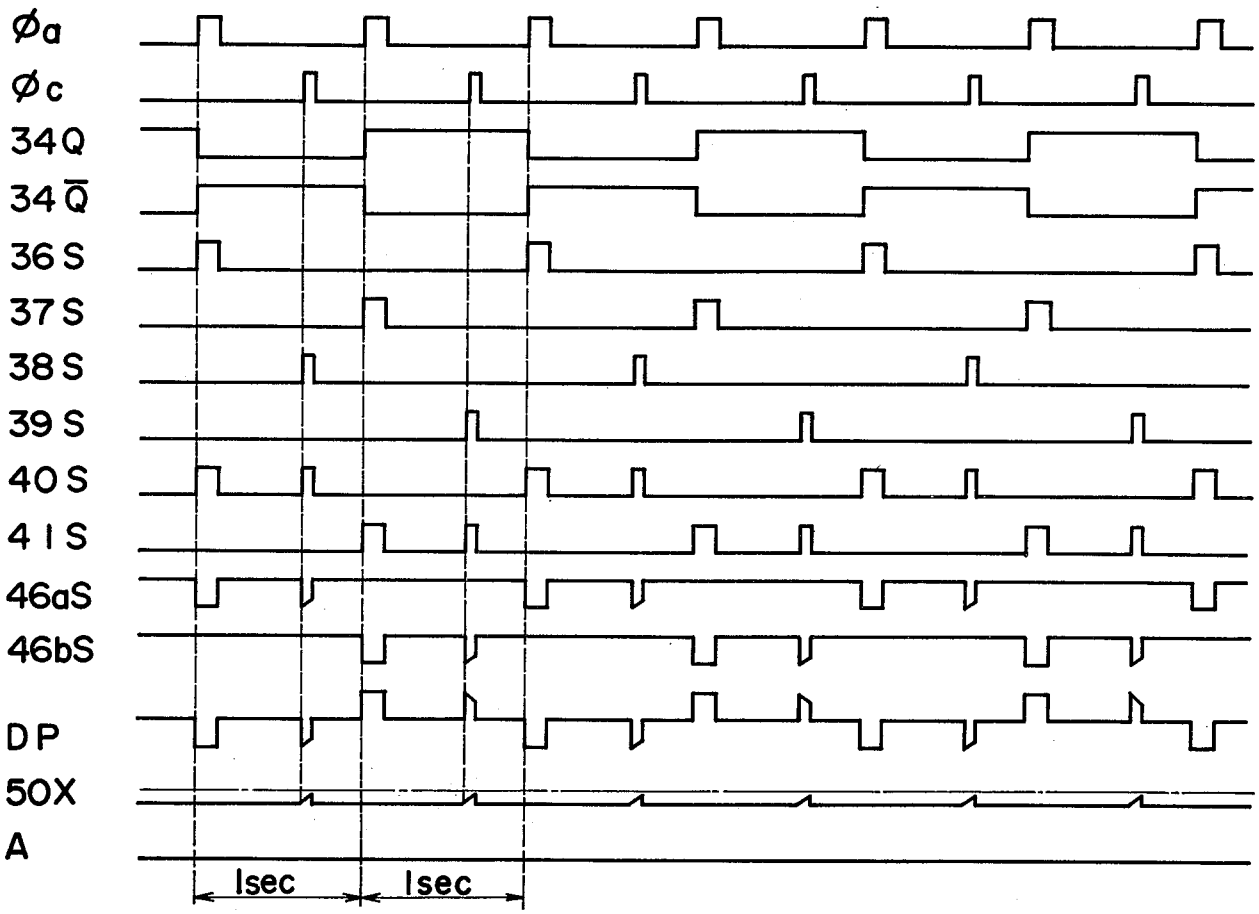
FIG. 6 shows the timing chart indicative of the output change of each portion of the circuit in FIG. 5 in normal operation.

FIG. 6 shows the timing chart of waveforms at each part of the drive circuit 5 and the non-operation detecting circuit 9 of the electronic watch during the normal operation. The waveform 34Q indicates the output Q of the FF34; 34$\overline{Q}$, the output $\overline{Q}$ of the FF34; 36S, the output from the NOR gate 36; 37S, the output from the NOR gate 37; 38S, the output from the AND gate 38; 39S, the output from the AND gate 39; 40S, the output from the OR gate 40; 41S, the output from the OR gate 41; **46*a*S, the voltage at the point 46*a*; 46*b*S, the voltage at the point 46*b*; $D_p$, the drive pulse to be applied to the coil 47; A, the non-operation signal produced from the non-operation detecting circuit 9; and 50X, the threshold voltage of the inverter 51 as a binary logic circuit. As known from the FIG. 6**, the non-operation signal A is not produced during the normal operation.

Next, the operation of the circuit will be explained with reference to the drawings FIG. 7 through FIG. 10, wherein the stepping motor 6 is not operative and the non-operation signal A is produced in response to either the first detection pulse $\phi$c or the second detection pulse $\phi$d.

Figure 7:
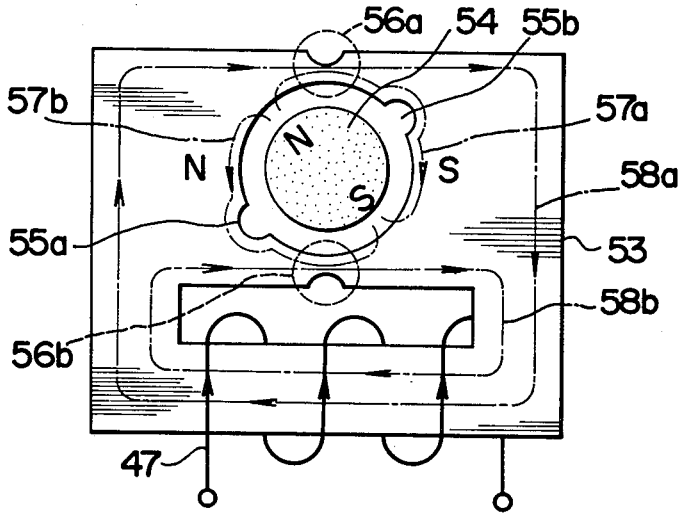
FIGS. 7 and 8 show operating diagrams of the stepping motor.
Figure 8:
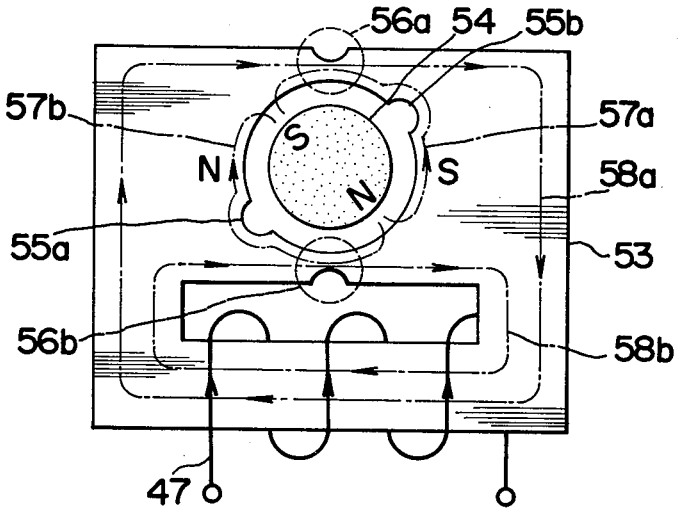

FIGS. 7 and 8 shows the illustrative diagrams for explaining the operation principle of the stepping motor 6. In the structure, in the stator 53 magnetically coupled with a magnetic core (not shown) for which the coil 47 should be wound, notches **55*a* and 55*b* are formed which determine the rotational direction of the rotor 54 magnetized in two poles in the direction of the diameter. Likewise, the magnetic saturatable portions 56*a* and 56*b* are formed. When current is not flowing in the coil 47, the rotor 54 stands still at the position of an angle of approximately 90° between the notches 55*a*, 55*b* and the magnetic pole of the rotor. When current is flowing through the coil 47, the magnetic resistance (reluctance) of the magnetic circuit viewed from the coil 47 is very low and the time constant $\tau$ of the R, L series circuit is large before the saturatable portions 56*a*, 56*b* of the stator 53** saturate, thus showing the slow rising characteristic in the current waveform.

This characteristics can be expressed by the following formula:

$$\tau = N^2/(R \times Rm)$$

where

L: the inductance of the coil 47

N: the number of turns of the coil 47

Rm: magnetic reluctance

When the saturatable portions **56*a* and 56*b* of the stator 53** saturate, the time constant $\tau$ of the circuit becomes small as a result of the increase of the reluctance Rm as the magnetic permeability of the saturated portions become equal to that of the air, thus the current waveform suddenly rises. In the electronic watch according to the present invention, the detection of the non-operating condition of the stepping motor can be performed by the utilization of the fact that the time constant of the R-L series circuit becomes different by the differences in the direction of the current flowing through the coil and the position of the rotor. The reasons for the differences in the time constant will be described in the following.

Figure 9:
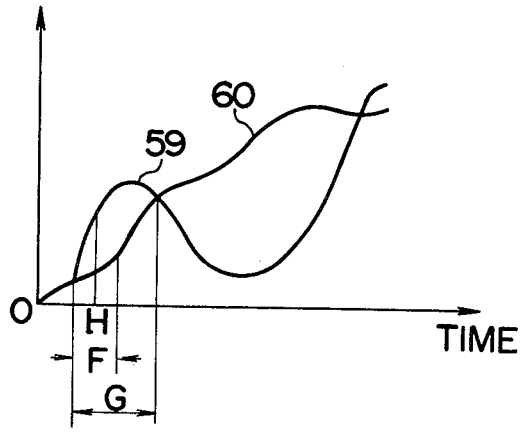
FIG. 9 shows waveform of the current flowing through the coil of the stepping motor.

FIG. 7 shows the condition of the magnetic field when the rotor 54 is in the rotatable position against the direction of the current flowing through the coil 47. The numerals **57*a* and 57*b* show the magnetic fluxes produced from the rotor 54. In fact there is also a magnetic flux which interlinks with the coil 47, but this is omitted from the drawing. When the current is flowing in the direction of the arrow through the coil 47, the magnetic fluxes 58*a* and 58*b* which are produced respectively by the coil 47 are strengthened by the magnetic fluxes 57*a* and 57*b* produced from the rotor 54 and they saturate rapidly. Afterwards, in the stator 53, there occurs a magnetic flux sufficient for rotating the rotor 54, but this is also omitted from the drawings. FIG. 9 shows the current waveform 59 flowing through the coil 47** at this time.

Next, an explanation is made with respect to the case in which the direction of the current is opposite to the case of FIG. 7 and the rotor 54 can not be rotated. The magnetic fluxes produced by the rotor 54 and the coil 47 cancel each other out in the saturatable portions **56*a* and 56*b* of the stator 53, and much time is required to saturatable the fluxes at the saturable portions 56*a* and 56*b*. The waveform 60 in FIG. 9 shows that of the current flowing through the coil 47 in this case. In FIG. 9, the letter F shows the time difference before the saturatable portions 56*a* and 56*b* of the stator 53 saturate. As will be apparent from the two currents shapes 59 and 60 in FIG. 9, the inductance of the coil 47 is small when the rotor 54** is rotating and is large when it is not rotated within the range G.

The "H" point in FIG. 9 corresponds to the pulse width of the first detection pulse $\phi$c and the second detection pulse $\phi$d and the change in the current in the coil 47 due to the pulse $\phi$c and the pulse $\phi$d terminates at the "H" point.

Figure 10:
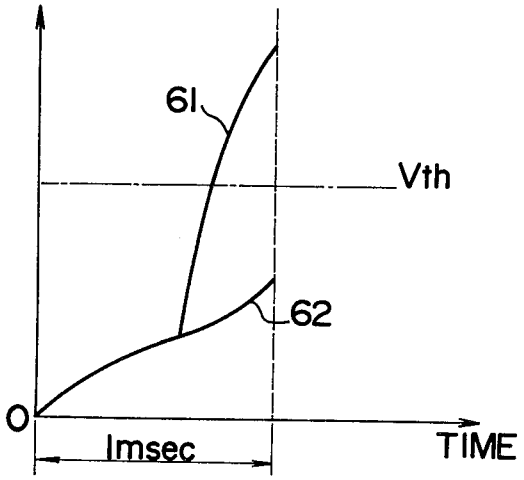
FIG. 10 shows a waveform of the terminal voltage of a resistor in the non-operation detecting circuit shown in FIG. 5.

FIG. 10 shows the change of the condition of the voltage across the terminals of the resistor 50 when the current flowing through the coil 47 changes as shown by the wave shapes 59 and 60 in FIG. 9 in which the voltage waveform 61 shows the wave form when the rotor 54 is in the rotatable position, while the voltage waveform 62 shows the waveform when the rotor 54 is not in the rotatable position. When the direction of the current flowing through the coil 47 is the one which enables the rotor 54 to rotate, the terminal voltage of the resistor 50 which is a dividing voltage of the power supply becomes higher than the threshold voltage $V_{th}$ of the inverter 51 as shown in FIG. 10 and the output of the inverter 52 becomes the logical "0". Also, when the direction of the current flowing through the coil 47 is the one in which the rotor 54 can not be rotated, the terminal voltage of the resistor 50 does not become higher than the threshold voltage $V_{th}$ of the inverter 51 as shown in the wave form 62 and the output of the inverter 51 remains at the logical "1".

As shown in FIG. 5, when the stepping motor 6 is operated normally either the transistor 48 or the transistor 49 in the non-operation detecting circuit 9 is rendered conductive in response to the first detection pulse $\phi$c, while the transistor 42 or the transistor 44 in the drive circuit 5 is rendered non-conductive. As a result, a closed loop circuit is formed through the transistor 44, the coil 47, the transistor 48, and the resistor 50 or a closed loop circuit is formed by the transistor 42, the coil 47, the transistor 49 and the resistor 50, so that the terminal voltage of the resistor 50 changes as shown by 50X. In this case, the direction of the current flowing through the coil 47 in response to the first detection pulse $\phi c$ following the standard pulse $\phi a$ is same as that of the current flowing through the coil 47, so that the current due to the first detection pulse $\phi c$ flows in the direction which does not permit the rotor 54 to be rotated. In this case, the terminal voltage of the resistor 50 goes above the and threshold voltage $V_{th}$ of the inverter 51 and non-operation signal is produced from the non-operation detecting circuit 9.

Figure 11:
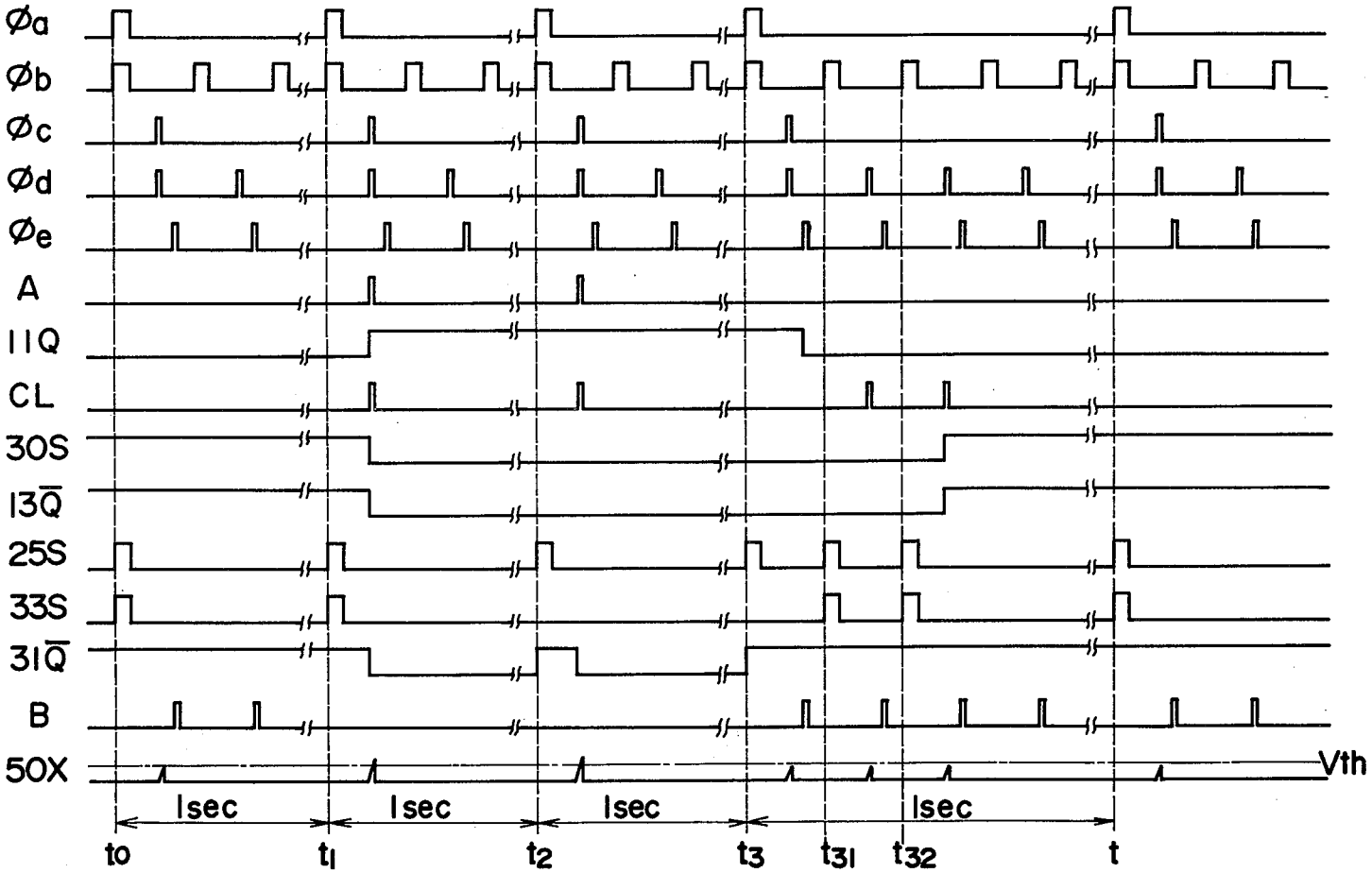
FIG. 11 shows the timing chart of the output change in each circuit portion of the stepping motor at the time of non-operation.

FIG. 11 shows the timing chart for showing the operation of each portion of the circuit of the electronic watch in the case where it is placed in a strong D.C. magnetic field and the stepping motor 6 has stopped operating. In the figure, the waveform 11Q is the output Q of the first FF 11, CL is the clock signal to be applied to the clock terminal of the counter 12 which signal is produced from the OR gate 21 in the first gate circuit 16; 30S, the output of the NOR gate 30; 25S, the output of the OR gate 25 in the second gate circuit 22; 33S, the output of the AND gate 33 in the drive circuit 5; 31$\overline{Q}$, the output $\overline{Q}$ of third FF 31; B, the rotation signal to be produced when the motor 6 is rotating, which is produced from the AND gate 32 in the rotation detecting circuit 10; and 50X is the terminal voltage of the resistor 50. FIG. 11 shows the output change of each circuit portion wherein the stepping motor 6 corresponds to the standard pulse $\phi a$ which is produced at the time of to while the stepping motor 6 does not correspond to the standard pulses occuring at the time $t_1$ and $t_2$ and the motor 6 is operated again by the pulse $\phi a$ occuring at the time $t_3$, so that the stepping motor 6 is in the non-operation condition by only two standard pulses $\phi a$ in total. When the motor 6 is not operated by the pulse $\phi a$ at the time of $t_1$, the non-operation signal A is produced from the non-operation circuit 9 in response to the first detecting pulse $\phi c$, thus setting the third FF 31. Namely, the output Q of the first flip-flop 11 becomes the logical "1" and at the same time the counter 12 is controlled in operation in the up-mode, while the clock pulse corresponding to the non-operation signal A is applied to the counter 12. As soon as the counter 12 counts one, the output of the NOR gate 30 becomes logical "0" and the second "FF" 13 is set. Although the third FF 31 is reset in response to the standard pulse $\phi a$ occuring at the time of $t_2$, the third FF 31 is again set by the non-operation signal A occuring again by the non-operating condition of the stepping motor 6, so that the rotation signal B is not produced from the rotation detecting circuit 10. At this time, the clock pulse is applied to the counter 12 by the second non-operation signal A and the content of the counter becomes 2. When the stepping motor 6 is operated by the pulse $\phi a$ occuring at the time of $t_3$, then no non-operation signal A is produced in response to the next first detection pulse $\phi a$ so that the third flip-flop 31 which has been reset by the pulse $\phi a$ is maintained at the reset condition, thus producing the rotation signal B from the AND gate 32 in the rotation detecting circuit 10 in response to the third detection pulse $\phi e$.

The first FF 11 is reset by the rotation signal B and the output Q goes to logical "0" so that the operation of the counter 12 is changed from the up-mode to the down-mode. In this condition, the output of the NOR gate 14 goes to logical "1" and the pulse to be supplied from the second gate circuit 22 to the drive circuit 5 changes from the standard pulse $\phi a$ of 1 Hz to the quick feed pulse $\phi b$. At the same time, the output from the third gate circuit 26 to be supplied to the non-operation detecting circuit 9 changes from the first detection pulse $\phi c$ of 1 Hz to the second detection pulse $\phi d$ of 16 Hz. Accordingly, the stepping motor 6 operates in response to the quick feed pulse $\phi b$ occurring at the time of $t_{31}$ and at the same time, the clock is applied to the counter 12 from the first gate circuit 16, in response to the second detection pulse $\phi d$ so that the count of the counter 12 changes from 2 to 1. The motor 6 is operated again by the quick feed pulse $\phi b$ occurring at the subsequent $t_{32}$ time and the clock is applied to the counter 12, thus the count of the counter 12 becomes 0. Accordingly, the output of the NOR gate 30 goes to logical "1" and the second FF 13 is reset so that the output of each circuit portion goes to the normal operating condition.

As described in the above, when the stepping motor 6 is in the non-operable condition for some reason, the number of times of the non-operating condition is counted by the counter 12. Also, when the stepping motor 6 returns to the operable condition, the quick feeding is automatically performed for the number of non-operation times by the quick pulse $\phi b$ and the indication of the hands 8 are returned to the normal time position, so that the of displaying time due to the non-operation is corrected. In this case, by making the counting capacity of the counter larger, the displaying time of the hands 8 can be returned to the normal time position even if the stepping motor 6 is not operated over several hours, although it takes much time for the count of the counter 12 to return to zero after returning to the normal operation. In the above operation, even if the stepping motor 6 is not operated again during the quick feeding of the motor 6, the counter 12 is again rendered in the up-mode by the occurrence of the non-operation signal A and the number of non-operation times is accumulated, thus automatically obtaining the quick feeding after returning to the normal operation.

In the electronic watch according to the present invention described above, since the non-operation detection of the stepping motor is performed by utilizing the characteristic of the electric current flowing through the coil, it can be carried out without changing the ready made stepping motor. In addition, when the saturation time difference due to the rotor position of the saturatable magnetic path of the stepping motor of the integral stator type is to be detected, the circuit is constructed by the switching elements such as transistors and resistor elements which can be formed in IC circuits without increasing the cost. Moreover, by providing an intermediate terminal to a resistor as a detecting element in the non-operation detecting circuit and by adapting to select the resistance with the provision of a pad in the IC, the correction the discrepancies among resistances produced during the manufacturing process of the IC can be realized as well as the utilization of the IC with the stepping motor. In the embodiment according to the present invention, a resistor is used as a detecting element. However, this can be a coil, or a capacitor as a passive element. Also, it is possible to construct the circuit with an active element such as a MOS type field effect transistor. By using an inverter consisting of a C type MOS transistor as the binary logical circuit in the non-operation detecting circuit, the threshold voltage becomes half of that of the power supply, so that the non-operation detecting circuit can be constructed, which is free from the effect of fluctuation in the supply voltage.

In the foregoing, the electronic watch according to the present invention has been described with the embodiments in conjunction with the drawings, but this is not limited to the embodiments disclosed. It is apparent that various modification and variation will be possible without departing from the spirit and scope of this invention.

As described in the foregoing, in the electronic watch according to the present invention, the non-operative condition of the stepping motor is detected by the non-operation detecting circuit and the number of times it is capable of not responding to the standard pulse of a period in which the stepping motor becomes non-operative is stored as the base of the time measurement. After the detection of the operating condition of the stepping motor by the rotation detecting circuit, the motor is automatically quick fed by the quick feed pulse by the amount proportional to the non-operation condition, so that even if the hands stop temporarily due to the non-operative condition of the stepping motor under the effect of a strong D.C. magnetic field, the movement of the hands can be automatically performed to the correct time display position. This eliminates the defect perculiar to the analog type electronic watch utilizing the conventional stepping motor, thus attaining the predetermined purpose as well as yielding a striking effect when practicing the invention.

We claim:

1. In an electronic watch having an oscillation circuit for producing a time base signal with a predetermined frequency, a frequency dividing circuit having a plurality of frequency dividing stages for dividing down the time base signal, a pulse generating circuit receptive of the outputs of the dividing stages of said frequency dividing circuit for producing standard pulses and quick feed pulses having a period shorter than that of said standard pulses, a stepping motor for moving a time hand to display time, and a drive circuit receptive of the standard pulses for driving said stepping motor, the improvement comprising: a non-operation detecting circuit for detecting a non-operative condition of said stepping motor and for producing a non-operation signal each time the stepping motor fails to operate in response to one standard pulse; counting means for counting the number of said non-operation signals; a rotation detecting circuit for detecting the resumption of operation of said stepping motor from the non-operative condition in response to a standard pulse; and a quick feed control circuit for quickly advancing said stepping motor in response to an output from the rotation detecting circuit by thereafter supplying to said drive circuit, in place of a standard pulse, a set of quick feed pulses equal in number to the number of non-operation signals counted in said counting means.

2. An electronic watch according to the claim 1, wherein said pulse generating circuit comprises means for generating a first detection pulse having the same period as the standard pulse but different in phase, a second detection pulse which has the same period as but a different phase than the quick feed pulse, and a third detection pulse which has the same period as but a different phase than the second detection pulse and said standard pulse and said quick feed pulse, and wherein the non-operation detecting circuit includes means responsive to the first or second detection pulse for detecting the non-operative condition of the stepping motor and the rotation detecting circuit includes means responsive to the third detection pulse for detecting the resumption of operation of the motor.

3. An electronic watch according to claim 2, wherein said quick feed control circuit further comprises a first flip-flop circuit set in response to the output of the non-operation detecting circuit and reset in response to the output of the rotation detecting circuit, an up-down counter controlled by the output of the first flip-flop circuit to be in the up or down count mode, a second flip-flop circuit set by the output of said first flip-flop and reset in response to the condition when the count of said up/down counter becomes zero, a first gate circuit responsive to the output of the first and second flip-flop for supplying the standard pulse to the up/down counter as a clock pulse when said up/down counter is in the up-mode and for supplying the standard pulse to the counter as a clock, a second gate circuit for supplying the quick feed pulse to the drive circuit in response to the output of the second flip-flop circuit when said up/down counter is in the down mode, and a third gate circuit for selectively supplying the first or second detection pulse to the non-operation detecting circuit.

4. An electronic watch according to claim 3, wherein said drive circuit comprises a reverse control circuit for alternatively reversing the direction of the current flowing through the coil of the stepping motor in response to the standard pulse or the quick feed pulse and a gate circuit for disconnecting the supply of the standard pulse or the quick feed pulse in response to the output of the first flip-flop in the non-operation detecting circuit at the time of non-operation of the stepping motor.

5. An electronic watch according to claim 2, claim 3, or claim 4, wherein said non-operation detecting circuit comprises two switching elements selectively controlled in the ON and OFF states in response to the output of one of the first detection pulse or the second detection pulse and connected to each end portion of the coil of the stepping motor, a detecting element for converting the amount of the current flowing through the coil through the switching elements in the ON state into a divided voltage and a binary logic circuit to which the output of said detecting element is applied.

6. An electronic watch according to claim 5, wherein said detecting element comprises a passive element and the voltage at the end connected with the switching elements is supplied to the binary logic circuit.

* * * * *